United States Patent [19]

Neuzeret et al.

[11] Patent Number: 4,478,236

[45] Date of Patent: Oct. 23, 1984

[54] DISCONNECTOR FOR HYDRAULIC CIRCUITS

[75] Inventors: Bernard Neuzeret; Jean Richard; Jean-Francois Comeau, all of Saone et Loire, France

[73] Assignee: Socla, S.A., France

[21] Appl. No.: 349,748

[22] Filed: Feb. 18, 1982

[30] Foreign Application Priority Data

Jan. 26, 1982 [EP] European Pat. Off. ..... 26/01/1982

[51] Int. Cl.[3] ..... F16K 17/04; G05D 7/01

[52] U.S. Cl. ..... 137/107; 137/218

[58] Field of Search ..... 137/107, 218, 613, 590, 137/588, 808, 811; 222/525, 478, 481.5, 510, 564, 547, 460; 251/157; 141/333

[56] References Cited

U.S. PATENT DOCUMENTS 2,503,424 4/1950 Snyder ..... 137/218

FOREIGN PATENT DOCUMENTS 1902948 1/1969 Fed. Rep. of Germany ..... 137/588

*Primary Examiner*—Martin P. Schwadron
*Assistant Examiner*—John S. Starsiak, Jr.
*Attorney, Agent, or Firm*—Remy J. VanOphem

[57] ABSTRACT

The invention concerns a hydraulic disconnector to separate an inflow circuit from outflow from an outflow circuit.

Controlled by the membrane, the valve opens the drainage of chamber if the outflow circuit flows back in the direction of the arrow. The spring opens this drainage even if the membrane is punctured.

4 Claims, 4 Drawing Figures

1
2
3
4
5
6
7
8
9
10
11
12
13
14
15
16
17
18
19
20
21
22
23
24
25
26
27
28
29
30
31
32
35
IV
IV 16
11
3
22
25
17
26
21
18
28
6
29
7
15

DISCONNECTOR FOR HYDRAULIC CIRCUITS

BACKGROUND OF THE INVENTION

1. Field of the Invention

The present invention concerns a disconnecting apparatus intended for fitting to hydraulic circuits when it is desired to avoid pollution. It may be water, principally drinking water, or any one of various liquids used in the chemical industry.

The principle of the disconnecting apparatus is as follows.

When liquid flows in the direction which is considered normal, the disconnector allows free communication between the inflow circuits and the outflow circuits. If the direction of flow of the liquids is reversed, the disconnector automatically closes and prevents the liquid in the outflow circuit, which is considered polluted, from flowing back into the inflow circuit.

Disconnectors operating according to this principle are known. In the case of reversal of the flow, the disconnector protects the inflow circuit and discharges to the exterior the liquid coming from the outflow circuit. This is useful, for example, in the chemical industry to prevent polluted water from flowing back toward the source of clean water, in the event a valve has become defective and ceases to be watertight. In addition, if the interior space of the disconnector forms a dead zone, it must be guaranteed that there is no risk of the polluted water which is contained in this dead zone being sucked back into the inflow circuit.

2. Prior Art

Disconnecting apparatus allowing certain results to be achieved are known, but they present some disadvantages.

Certain ones are of very complicated construction. The majority present a risk. For example, even if they function adequately under normal circumstances, their design does not assure complete safety. As a result, serious incidents can occur.

The present invention has the aim of avoiding these disadvantages by achieving a disconnecting apparatus in which any operating accident gives rise to a leak visible from the exterior without however allowing any sucking back whatsoever of the polluted ouflow liquid.

In addition, the invention aims at achieving a disconnector of simple construction, using only valves and membranes of conventional type.

SUMMARY OF THE INVENTION

A hydraulic disconnector according to the invention includes a hollow body provided with a coupling connection for the inflow circuit and a coupling connection for the outflow circuit, fitted respectively with a primary automatic spring valve and with a secondary automatic spring valve. Disposed between the seats of these two valves is an intermediate chamber having a lower part in which there is a fixed seat for a discharge aperture which opens to the exterior. This fixed seat cooperates with a discharge valve situated at the lower part of a movable vertical rod of which the upper part is linked to a membrane surmounted by a pressure chamber which communicates directly with the inflow coupling connection.

According to another characteristic of the invention, the vertical rod of the discharge valve is hollow, its lower end being permanently open to the exterior, while its upper end is able to be blocked by an intermediate seat fixed to the body.

According to another characteristic of the invention, a spring, bearing on the intermediate seat located under a dish fixed below the membrane, tends to separate, at the same time, the discharge valve and the upper end of the hollow rod from their respective seats.

According to another characteristic of the invention, the lower part of the intermediate cavity is formed from blades inclined in such a way as to cause a vortex to appear in the liquid which increases the speed of drainage of this intermediate zone when the discharge valve is opened. This arrangement, coupled with the affect of the entry of air which is produced through the hollow rod, causes, in case of emergency, an extremely rapid drainage of polluted liquid which may be contained in the intermediate cavity.

According to another characteristic of the invention, an upper dish, attached to the membrane, and a lower dish are able to cooperate with a fixed seating in the upper part of the body, the central part of this seating communicating with the inflow pressure chamber.

The attached drawing, given by way of non-limiting example, will allow the characteristics of the invention to be better understood.

DETAILED DESCRIPTION OF THE PREFERRED EMBODIMENT

Figure 1:
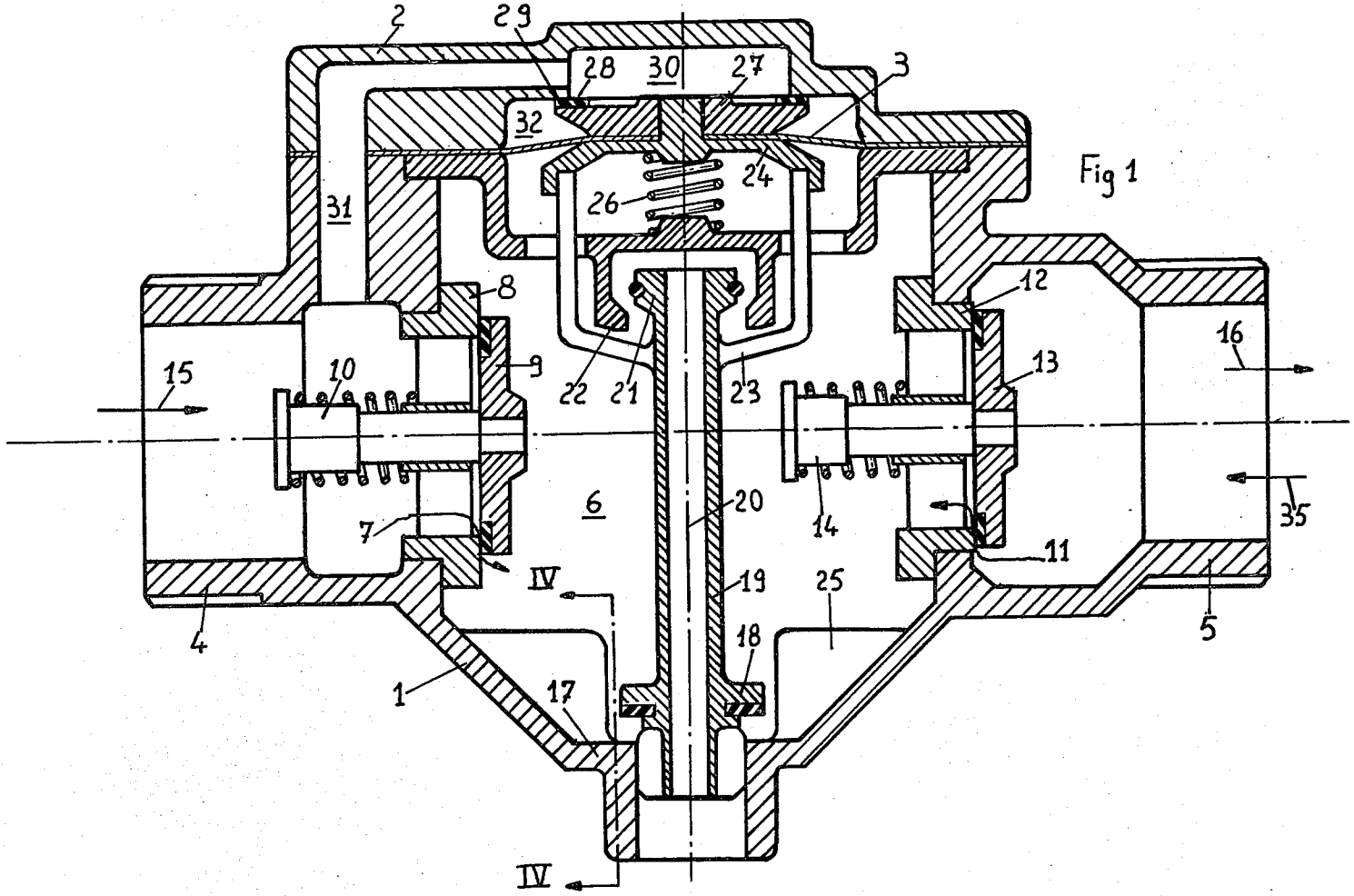
FIG. 1 is a view in longitudinal section of a disconnector according to the invention in the rest position.

The disconnector illustrated in the drawings includes a hollow body 1 capped by a cover 2 which closes it so as to be watertight. Between the hollow body 1 and the cover 2 the edges of a flexible watertight membrane 3 are clamped so that the central part remains able to move.

The hollow body 1 is provided with a coupling connection 4 for an inflow circuit and a coupling connection 5 for an outflow circuit.

An intermediate chamber 6 is formed in the center of the hollow body 1 and is separated from the coupling connection 4 by a primary automatic valve 7 formed by a fixed seat 8 in front of which a blocking component 9 can translate under the action of a return spring 10. The intermediate chamber 6 is also separated from the outflow coupling connection 5 by a secondary automatic valve 11. The secondary automatic valve includes a fixed annular seat 12, in front of which is a blocking component 13 which moves under the thrust of a return spring 14.

Figure 2:
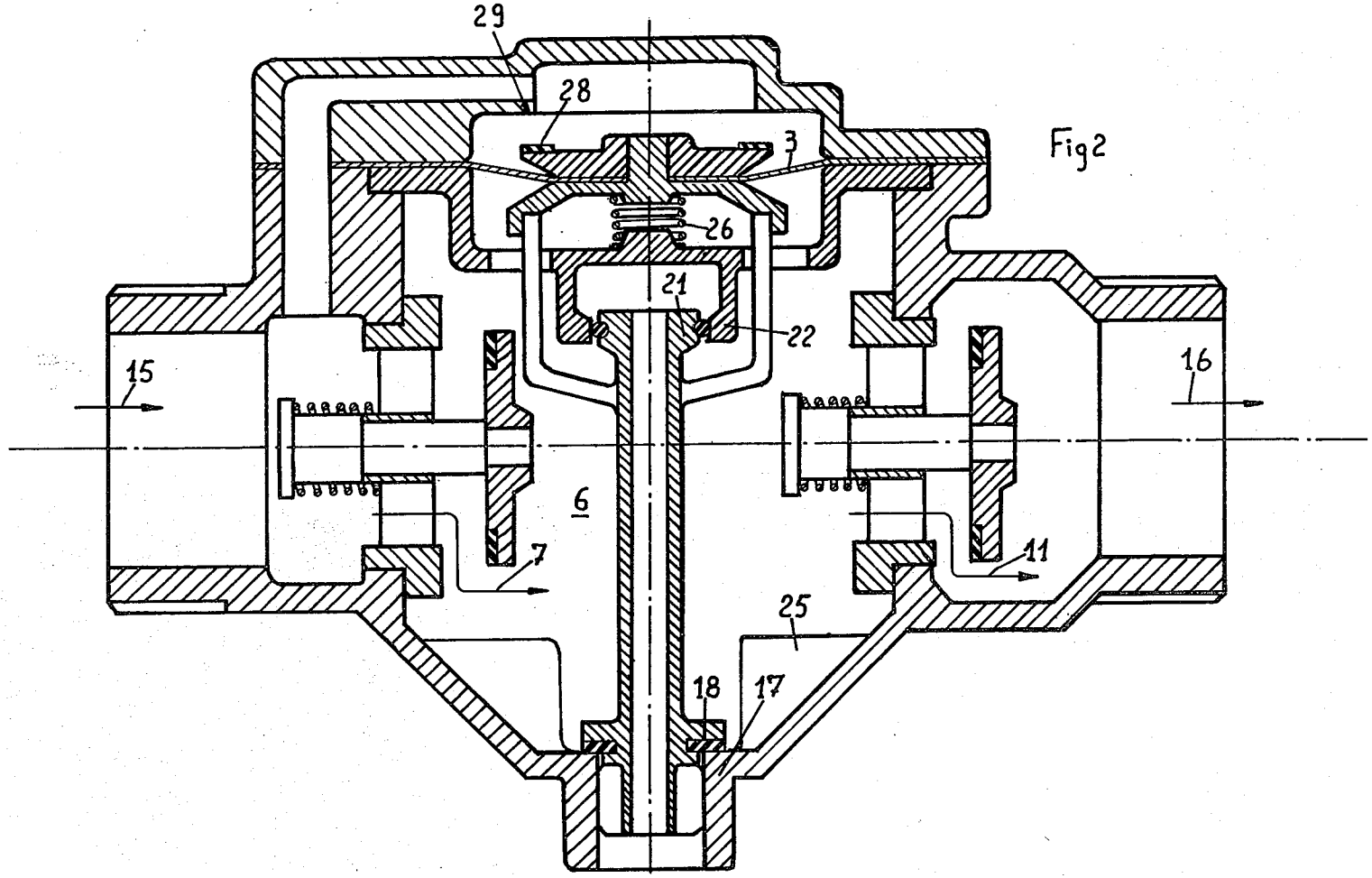
FIG. 2 is a view similar to FIG. 1 illustrating the disconnector in the normal operating position.

As illustrated in the drawings, the primary valve 7 and the secondary valve 11 are aligned in the same direction and tend to open under the thrust of fluid pressure when the liquid circulates normally from the inflow coupling 4 to the outflow coupling 5, as indicated in FIG. 2 by the arrows 15 and 16.

The intermediate chamber 6 formed between the seats 8 and 12 of the primary valve 7 and the secondary valve 11, also opens to the exterior through a fixed discharge seat 17 situated in its lower part.

This fixed discharge seat 17 cooperates with a discharge closer 18 which is able to move to block the fixed discharge seat in a watertight manner. The discharge closer 18 is located at the lower end of a vertically movable rod 19, the upper end of which is connected to the central part of the membrane 3 by means which will now be described.

The vertical rod 19 of the discharge closer is hollow. An axially drilled air inlet 20 passes through its entire length and is permanently connected with the exterior atmosphere at its lower end which passes through the center of the fixed discharge seat 17. The upper end of the rod, which forms a closer 21, is able to move into sealing engagement with a seat 22 in the lower part of a chamber in communication with the air inlet 20.

The vertical rod 19 is fitted with radial arms 23 which pass through an intermediate roof to attach to a lower dish 24 in such a way as to unify the action of the membrane 3 with the discharge closer 18 and the air entry closer 21.

The lower part of the intermediate chamber is defined by blades 25 which are inclined in such a way as to cause a vortex or swirl to appear in the liquid, increasing the draining speed of the liquid in this zone when the discharge valves 17 and 18 are open.

The lower end of a compression spring 26 bears on the roof and an upper end bears under the lower dish 24. The action of this spring tends to lift the discharge closer 18 above its seat, and raise the air entry closer 21 above its seat 22.

Disposed above the membrane 3 is an upper dish 27 which is fixed to the lower dish through a central hole in the membrane 3. The membrane 3 is thus clamped and supported between the lower and upper dishes 24 and 27. The upper dish is fitted with an annular seal 28 adapted to seal against a seat 29 situated in the central part of the cover 2. A pressure chamber 30 is thus formed in the cover above the upper dish 27 on its seat 28. The pressure chamber 30 communicates directly with the inflow coupling connection 4 by a channel 31 which opens above the primary automatic valve 7.

The inflow pressure existing in the coupling connection 4 is applied permanently in the pressure chamber 30 whether the primary automatic valve 7 is open or shut. A second chamber 32 is likewise formed within the cover 2, between the annular seal 28 and the membrane 3.

The operation is as follows:

When the disconnector according to the invention is not engaged but is at rest, its components are in the positions shown in FIG. 1.

In other words, the primary valve 7 is closed, as is the secondary valve 11. The discharge valve 17 and 18 is open and the action of the spring 26 holds the annular seal 28 of the upper dish 27 onto the seat 29 so as to be watertight.

When the disconnector is engaged, between the inflow circuit connected to the coupling connection 4 and the outflow circuit connected to the coupling connection 5, it retains the rest position illustrated in FIG. 1 if the inflow pressure in the coupling 4 and in the chamber 30 is insufficient to cause the shutting of the closer of the discharge valves 17 and 18 and 21 and 22.

If, on the other hand, the pressure of the inflow liquid increases to cause the circulation of liquid in the direction indicated by the arrows 15 and 16, as shown in FIG. 2, the following successive movements may be observed. In a first phase, the primary valve 7 and the secondary valve 11 both remain closed. The increase of pressure in the chamber 30 begins to lower the central part of the membrane 3 such that the seal 28 leaves its seat 29. The inflow pressure is immediately applied to the entire surface of the upper face of the membrane 3. The central part of the membrane is then rapidly lowered, compressing the spring 26 until the discharge closer 18 is applied to the fixed seat 17 and the valve 21 is applied to its seat 22 in a watertight manner. Thereafter, the intermediate chamber 6 does not communicate with the exterior. At this moment, due to the effect of the calibration of the various springs, and of the dimensions given to the surfaces affected by the pressure, the primary valve 7 opens and a pressure lower than the inflow pressure is established in the intermediate chamber 6. Once this pressure is established in the intermediate chamber 6, causing the secondary valve 11 to open, the fluid can flow out through the connection 5, as indicated by the arrow 16 in FIG. 2.

If the current stops, the primary and secondary valves 7 and 11 are closed again. Due to the different calibrations of the springs, the pressure in the intermediate chamber remains lower than that in the coupling connection 4. The discharge valves or closers 18 and 21 remain on the seats 17 and 22.

If, on the other hand, the flow of the liquid tends to be reversed, that is to say, if the outflow liquid tends to flow back into the coupling connection 5, as shown in FIG. 1 by the arrow 35, which may be caused either by an increase in the outflow pressure or by a fall in the inflow pressure, the following operations may be observed.

First, in the case of an excess of outflow pressure the primary and secondary valves 7 and 11 will close. The secondary valve 11 prevents any return of the outflow fluid into the intermediate chamber 6. If, on the other hand, the secondary valve 11 becomes defective, the outflow pressure establishes itself in the intermediate chamber until it becomes sufficient to open the discharge valves 17 and 18, and 21 and 22. The polluted liquid coming from the outflow can then run out through the discharge valves 17 and 18 and 21 and 22.

Second, in the case of a decrease in the inflow pressure, the primary and secondary valves 7 and 11 will close. The inflow pressure becomes insufficient in relation to the pressure obtained in the intermediate chamber so that the spring 26 raises the membrane 3 and as a result, opens the valves 21 and 22 and 17 and 18. The polluted liquid contained in the intermediate chamber then runs out to the exterior through the seat 17. The polluted liquid flows rapidly to the exterior since exterior air is admitted through the air inlet 20 of the rod 19 and penetrates into the intermediate chamber 6 above the level of the liquid which is being drained, which liquid is made to swirl by the vortex caused by the blades 25.

Figure 3:
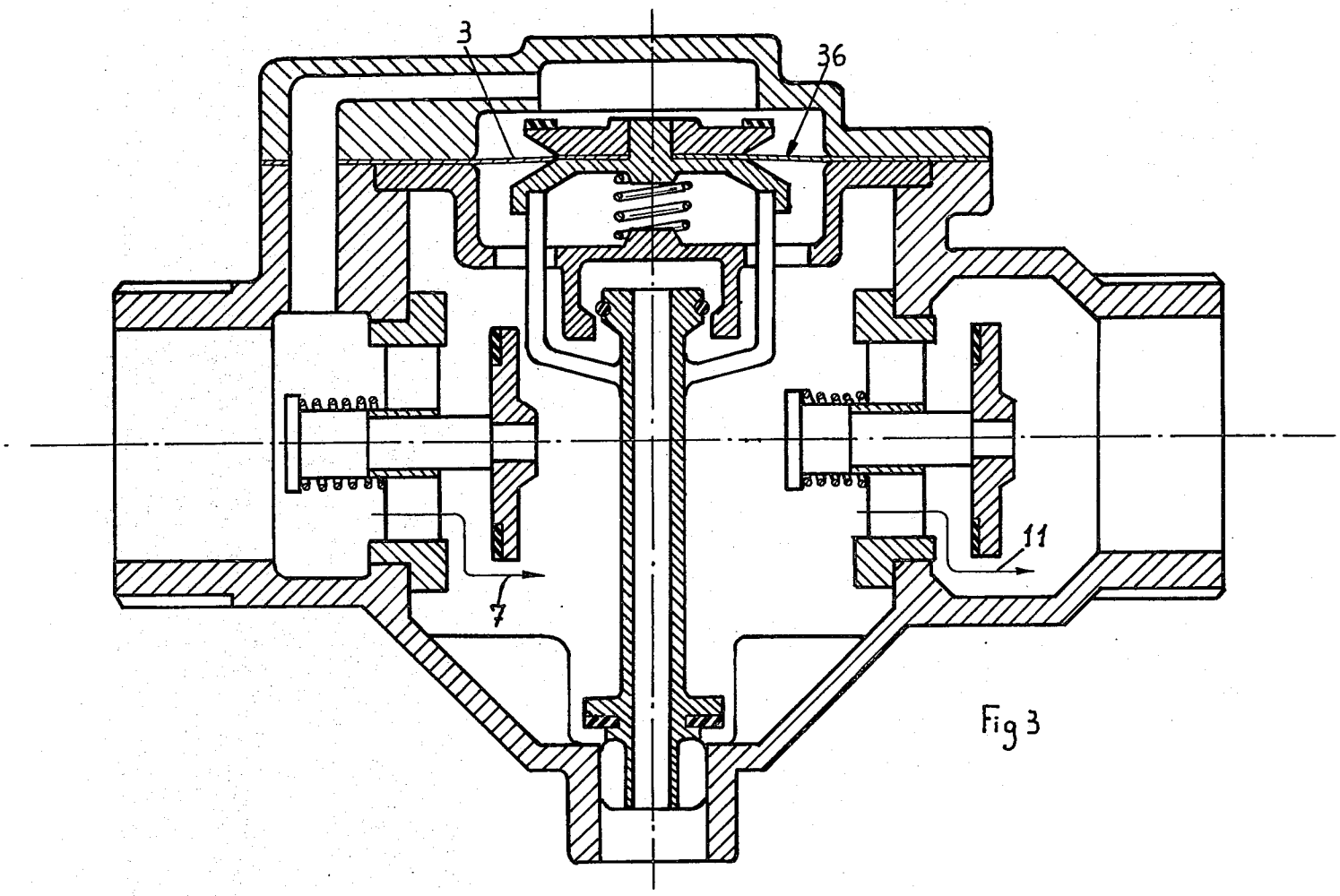
FIG. 3 illustrates the operation of the disconnector in the event of an accident, such as when the membrane is punctured.
Figure 4:
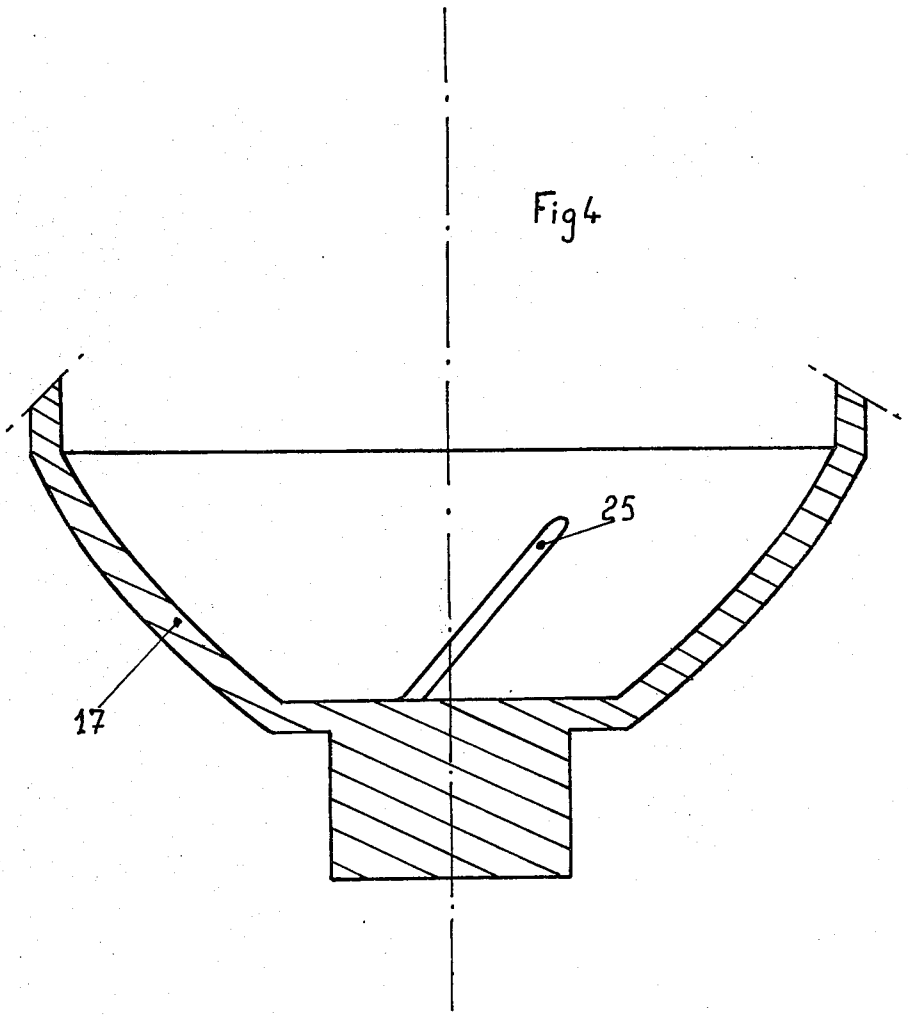
FIG. 4 is a sectional view along lines IV—IV of FIG. 1.

Third, as a result of an accident, the membrane 3 may be punctured, as shown at 36 in FIG. 3. In this case, the same pressure is applied on the two faces of the membrane 3 so that the spring 26 can act freely and open both the discharge valve 17 and 18 and the air inlet 21 and 22, as shown in FIGS. 1 and 3.

In this case, although the membrane 3 is punctured, the circulation of liquid occurs normally, as shown by the arrows 15 and 16; the inflow circuit runs no risk whatever of contamination by the polluted outflow circuit 5. The leak at the membrane is shown on the outside by an escape under the open seat 17. Therefore, the users have their attention drawn to the incident and they can effect repair without having run any risk of contamination of the inflow circuit 4.

In the case of FIG. 1, on the other hand, the outflow circuit tends to flow back (arrow 35) while the membrane 3 is punctured. Therefore, inflow fluid tends to penetrate through the membrane 3 into the intermediate chamber 6 to flow out to the exterior through the fixed seat 17 and attract the attention of the users. If the secondary valve 11 is watertight, nothing further occurs. If, on the other hand, the secondary valve 11 has also deteriorated, the outflow liquid flowing back into the intermediate chamber 6 also runs out through the seat of the discharge valve 17 and 18, since the annular seal 28 is on its seat 29, increasing the flow of the escape visible on the exterior, without however risking contamination of the clean liquid in the inflow coupling connection 4.

It will be seen that the disconnector according to the invention presents the following advantages. In particular, since the membrane 3 is situated in the upper part of the disconnector, the apparatus runs no risk of silting or clogging because of impurities carried by a fluid. The air inlet 20 disposed at the top of the hollow rod 19, facilitates drainage of the intermediate chamber 6. In the event of a rupture in the membrane 3, the spring 26 opens the valves 17 and 18 and 21 and 22, and closes the valves 28 and 29 to prevent polluted liquid from entering the inflow coupling connection 4. The vortex created by the inclined blades 25 allows rapid drainage of the dead zone defined by the intermediate chamber 6. Since the discharge valve is placed lower than the inflow valve, there is no risk of sucking back standing liquid which may be in the intermediate cavity when the discharge valve 17 and 18 is open.

It will be readily apparent to those skilled in the art that many variations and modifications may be made from the above described example of structure for the disconnecting apparatus. Such variations and modifications are included within the intended scope of the claims appended hereto.

What is claimed is:

1. A hydraulic disconnecting apparatus for interposition between an in-flow circuit and an out-flow circuit comprising:

A hollow body having an in-flow conduit and an out-flow conduit co-axial therewith about a flow axis, said conduits being adapted to be connected respectively to and between said in-flow circuit and said out-flow circuit and to flow a liquid under a fluid pressure therebetween and having an intermediate chamber interposed therebetween, said hollow body further having a cover member, an intermediate roof, and a floor, said floor comprising a bottom boundry of said intermediate chamber and having a first discharge aperture therethrough along a discharge axis orthogonal to said flow axis, said first discharge aperture when open communicating said intermediate chamber with the atmosphere, said cover member and said intermediate roof defining a membrane chamber therebetween intersecting said discharge axis, and said intermediate roof having an annular wall depending downwards from said membrane chamber along and about said discharge axis and further having roof opening means spaced radially outboard of said annular wall, said annular wall defining an atmospheric chamber and having a second discharge aperture about said discharge axis, said second discharge aperture when open communicating said atmospheric chamber and said intermediate chamber;

an automatic primary spring valve and an automatic secondary spring valve located along said flow axis on opposite sides of said discharge axis respectively in said in-flow connection conduit and said out-flow conduit;

membrane means vertically movable along said discharge axis and sealingly secured between said cover member and said intermediate roof to divide said membrane chamber into a pressure chamber communicating with said in-flow conduit and a lower chamber communicating with said intermediate chamber through said roof opening means; and discharge valve means comprising spring means and a tubular member having a lower end and an upper end extending respectively through said first and second discharge apertures to permanently communicate said atmospheric chamber with the atmosphere, said tubular member further having first and second sealing elements spaced axially along said tubular member on opposite sides of said flow axis and adapted to respectively close said first and second discharge apertures, said first sealing element closing said first discharge aperture in a direction with said fluid pressure in said intermediate chamber and said second sealing element closing second discharge aperture in a direction against said fluid pressure, said tubular member having arms means extending radially outwards and upwards about said annular wall and through said roof opening means, said arm means being affixed to said membrane means, whereby said spring means normally urge said membrane means and said tubular member affixed thereto upwards along said discharge axis to open said first and second discharge apertures.

2. The hydraulic disconnecting apparatus of claim 1 further comprising fluid swirling means upstanding from said floor in said intermediate chamber for increasing the draining speed of said fluid through said first discharge aperture from said intermediate chamber when said tubular member opens said first and second discharge apertures.

3. The hydraulic disconnecting apparatus of claim 2 wherein said swirling means comprise first and second blade means located on opposite sides of said first discharge aperture and inclined with respect to said discharge axis.

4. The apparatus of claim 1 wherein said floor is located horizontally below said in-flow and out-flow conduits so as to deter sediment and standing polluted fluid from being sucked into said in-flow conduit.

* * * * *